US008998327B2

(12) United States Patent
Cooney

(10) Patent No.: US 8,998,327 B2
(45) Date of Patent: Apr. 7, 2015

(54) MARINE SEAT

(75) Inventor: John R. Cooney, Midland, MI (US)

(73) Assignee: Avalon & Tahoe Manufacturing, Inc., Alma, MI (US)

( * ) Notice: Subject to any disclaimer, the term of this patent is extended or adjusted under 35 U.S.C. 154(b) by 0 days.

(21) Appl. No.: 13/193,857

(22) Filed: Jul. 29, 2011

(65) Prior Publication Data

US 2013/0025526 A1 Jan. 31, 2013

(51) Int. Cl.
*B60N 2/00* (2006.01)
*B63B 29/04* (2006.01)

(52) U.S. Cl.
CPC ..... *B63B 29/04* (2013.01); *B63B 2029/043* (2013.01); *B63B 2709/00* (2013.01)

(58) Field of Classification Search
USPC ..... 297/118, 111, 341–343
See application file for complete search history.

(56) References Cited

U.S. PATENT DOCUMENTS

| | | | | | |
|---|---|---|---|---|---|
| 2,309,445 | A * | 1/1943 | Edwards | 297/354.13 |
| 2,712,344 | A * | 7/1955 | Weber | 297/354.13 |
| 5,628,547 | A * | 5/1997 | Matsumiya | 297/354.11 |
| 5,678,264 | A * | 10/1997 | Walker | 5/613 |
| 5,868,460 | A * | 2/1999 | Christensen | 297/62 |
| 6,170,786 | B1 * | 1/2001 | Park et al. | 248/274.1 |
| 6,390,555 | B2 * | 5/2002 | Wilkins et al. | 297/354.13 |
| 6,412,870 | B1 * | 7/2002 | Higgins et al. | 297/342 |
| 6,739,651 | B1 * | 5/2004 | Barefoot | 297/118 |
| 6,742,842 | B2 * | 6/2004 | Dowty | 297/354.13 |
| 6,869,121 | B2 * | 3/2005 | Kayumi et al. | 296/37.15 |
| 6,929,320 | B2 * | 8/2005 | Laurent | 297/83 |
| 7,066,548 | B2 * | 6/2006 | Butler | 297/440.1 |
| 7,255,403 | B2 * | 8/2007 | Butler | 297/440.1 |
| 7,472,957 | B2 * | 1/2009 | Ferry et al. | 297/343 |
| 7,517,010 | B2 * | 4/2009 | Saint-Jalmes et al. | 297/118 |
| 7,533,930 | B1 * | 5/2009 | Fissette et al. | 297/118 |
| 7,997,654 | B2 * | 8/2011 | Ferry et al. | 297/342 |
| 8,201,291 | B2 * | 6/2012 | Burns et al. | 5/93.2 |
| 2003/0030306 | A1 * | 2/2003 | Raczkowski | 297/118 |
| 2008/0088160 | A1 * | 4/2008 | Johnson | 297/240 |

* cited by examiner

*Primary Examiner* — David R Dunn
*Assistant Examiner* — Alexander Harrison
(74) *Attorney, Agent, or Firm* — Reising Ethington PC

(57) ABSTRACT

A reclining marine seat is provided. An embodiment of the reclining marine seat marine seat comprises a seat back retainer section having at least one sidewall. The sidewall defines a top surface. The reclining marine seat further comprises a back having at least one sidewall. The sidewall defines a bottom surface. The back is pivotal between first and second positions with respect to the seat back retainer section. The bottom surface of the back does not extend above the top surface of the seat back retainer section during movement of the back between the first and second positions. The reclining marine seat further includes a seat. First and second frames are provided to support the back and seat.

18 Claims, 6 Drawing Sheets

MARINE SEAT

FIELD OF THE INVENTION

The present invention relates to a marine seat. More particularly, the present invention relates to a reclining marine seat.

BACKGROUND OF THE INVENTION

Boats, and particularly pontoon boats, typically include seats. Some seats may be used for lounging and reclining. The present invention relates to reclining seats for use on boats. Embodiments of the present invention may be used on boats including pontoon boats.

SUMMARY OF THE INVENTION

According to an embodiment, there is provided a reclining marine seat. The reclining marine seat comprises a seat back retainer section having at least one sidewall. The sidewall defines a top surface. The reclining marine seat further comprises a back having at least one sidewall defining a bottom surface. The back is pivotal between first and second positions with respect to the seat back retainer section. The bottom surface of the back does not extend above the top surface of the seat back retainer section during movement of the back between the first and second positions.

According to an embodiment, there is provided a reclining marine seat comprising a first frame. The reclining marine seat comprises a back supported on said first frame and being pivotal between first and second positions. The reclining marine seat further comprises an actuator coupled to the back and capable of moving the back between the first and the second positions. The back can be retained in any position between the first and the second positions.

According to an embodiment, there is provided a reclining marine seat comprising a seat back retainer section having at least one sidewall. The sidewall defines a top surface. The reclining marine seat further comprises a first frame and a back disposed on the first frame. The back has at least one sidewall defining a bottom surface. The back is pivotal between first and second positions with respect to the seat back retainer section such that the bottom surface of the back does not extend above the top surface of the seat back retainer section during movement of the back between the first and second positions. The reclining marine seat further comprises an actuator coupled to the back. The actuator is capable of moving the back between the first and the second positions. The back can be retained in any position between the first and the second positions.

Further areas of applicability of the present invention will become apparent from the detailed description provided hereinafter. It should be understood that the detailed description and specific examples, while indicating the preferred embodiment of the invention, are intended for purposes of illustration only and are not intended to limit the scope of the invention.

BRIEF DESCRIPTION OF THE DRAWINGS

The present invention will become more fully understood from the detailed description and the accompanying drawings, wherein.

DETAILED DESCRIPTION OF THE PREFERRED EMBODIMENTS

The following description of the preferred embodiment(s) is merely exemplary in nature and is in no way intended to limit the invention, its application, or uses.

Figure 1:
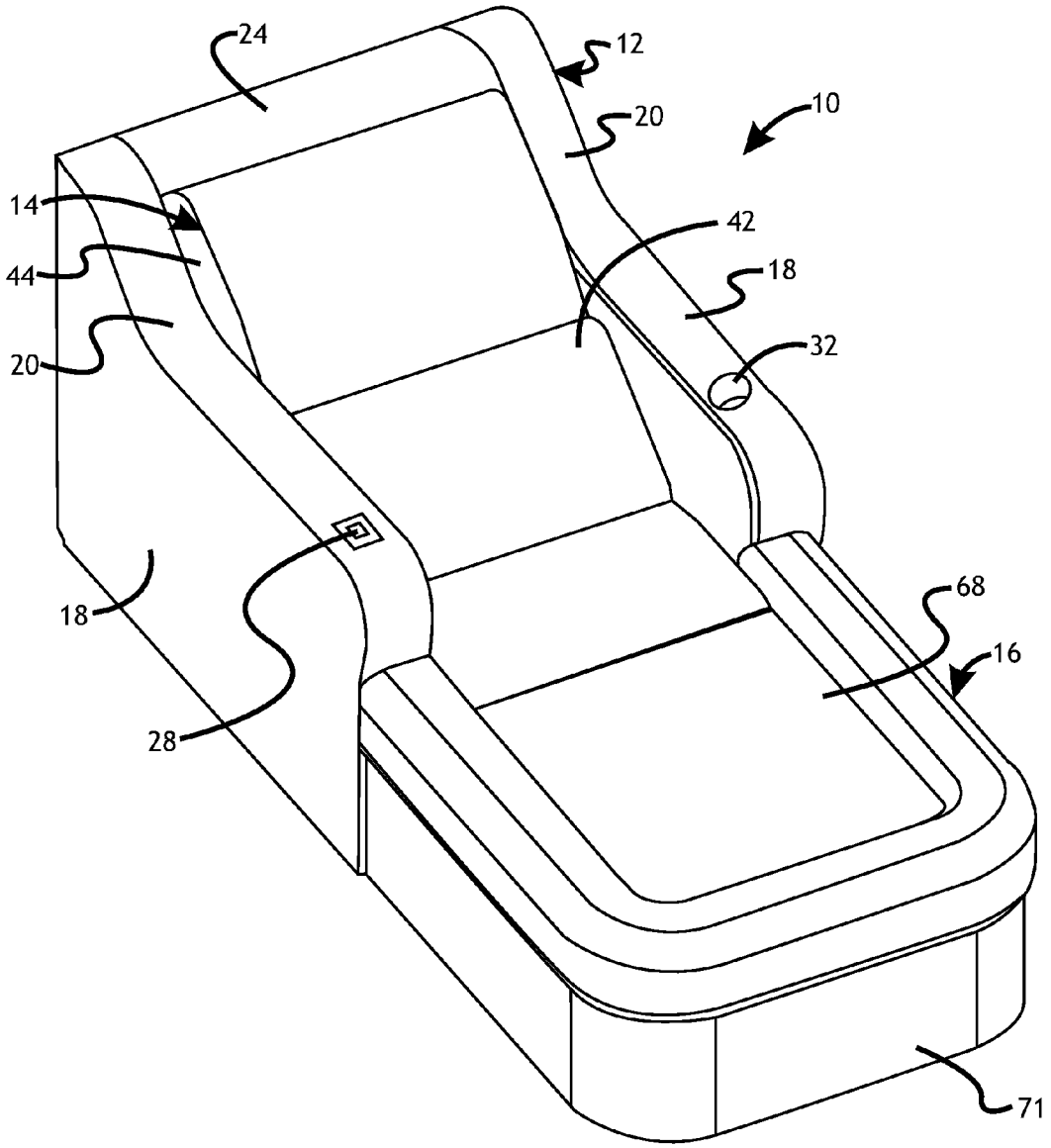
FIG. 1 is a perspective view of one embodiment having the back in a first position.
Figure 2:
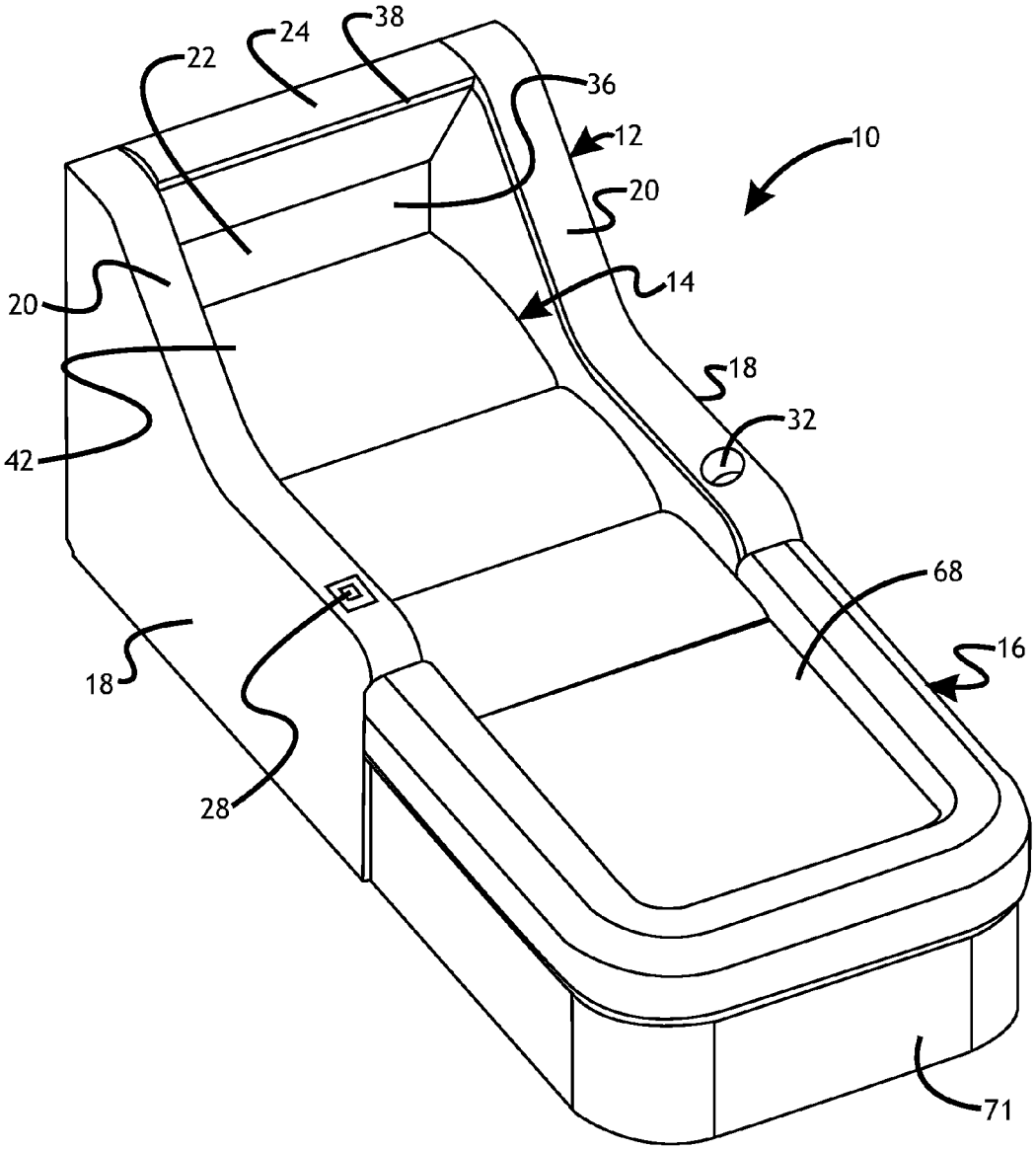
FIG. 2 is a perspective view of one embodiment having the back in a second position.

A reclining marine seat is generally indicated at 10 in the Figures. The reclining marine seat 10 includes a seat back retainer section generally indicated at 12. The reclining marine seat 10 further includes a back generally indicated at 14. The reclining marine seat 10 further includes a seat generally indicated at 16. The back 14 may be moveable between a first position (FIG. 1) and a second position (FIG. 2). The first position may be a relatively upright position. The second position may be a relatively reclined position which may be generally horizontal.

Figure 6:
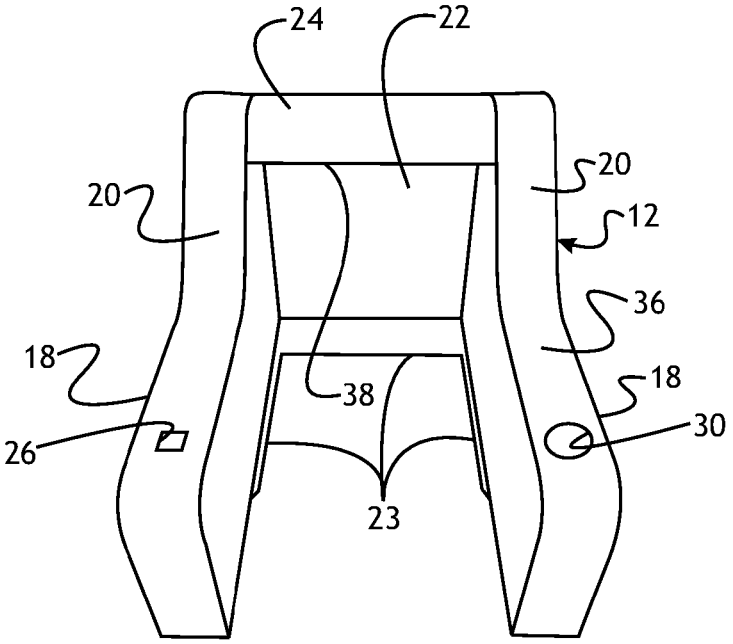
FIG. 6 is a perspective view of a portion of an embodiment.

The seat back retainer section 12 is best seen in FIGS. 1, 2, 6 and 7. The seat back retainer section is shown isolated in FIG. 6. The seat back retainer section 12 includes a sidewall 18. The sidewalls 18 define a top surface 20. A portion of the top surface 20 may be used as an armrest. In one embodiment, the seat back retainer section 12 may include a pair of sidewalls 18. A portion of the top surfaces 20 of sidewalls 18 may be used as an armrest. The seat back retainer section 12 may also include an intermediate wall 22 disposed between the pair of sidewalls 18. The intermediate wall 22 also defines a top surface 24. In one embodiment, the intermediate wall 22 and the pair of sidewalls 18 are connected to provide a generally u-shaped enclosure as best seen in FIG. 6.

The sidewalls 18 and intermediate wall 22 may each include an inwardly extending lip 23 at the bottom thereof. The inwardly extending lip 23 may be used to secure the seat back retainer section 12 with the deck of a boat (not shown). That is, suitable fasteners (not shown) may extend through the lip 23 into the boat deck to secure the seat back retainer section 12 or to a boat deck.

The sidewalls 18, intermediate wall 22 and lip 23 may include a frame 34 and may include a covering 36 on at least a portion of the frame 34. Further, padding 37 may be disposed between the frame 34 and covering 36. In one embodiment, the frame 34 may comprise wood. The inwardly extending lip 23 may comprise part of the frame 34 which may be secured to the deck of a boat as set forth above. It will be appreciated that the frame 34 may comprise any suitable material and take any suitable configuration. By way of non-limiting example, the frame 34 can also comprise metal or plastic. Further, the frame 34 may comprise a combination of materials.

The covering 36 may comprise any suitable covering for a marine environment. Suitable coverings may include a layered covering 36 including a stretchable substructure backing having a vinyl film thereon. The vinyl film may be secured to the substructure by a suitable adhesive. By way of non-limiting example, other suitable coverings may comprise water resistant fabrics, leather, simulated leather, or other plastics, or combinations of materials. It will be appreciated that a covering 36 may be configured to provide any desired contour to the seat back retainer section 12. Padding 37 may be interposed between the frame 34 and the covering 36. The padding 37 may be configured to provide any shape or contour for the seat back retainer section 12. The padding 37 may comprise open and/or closed cell foam or any other suitable material. The padding 37 may be molded.

Figure 3:
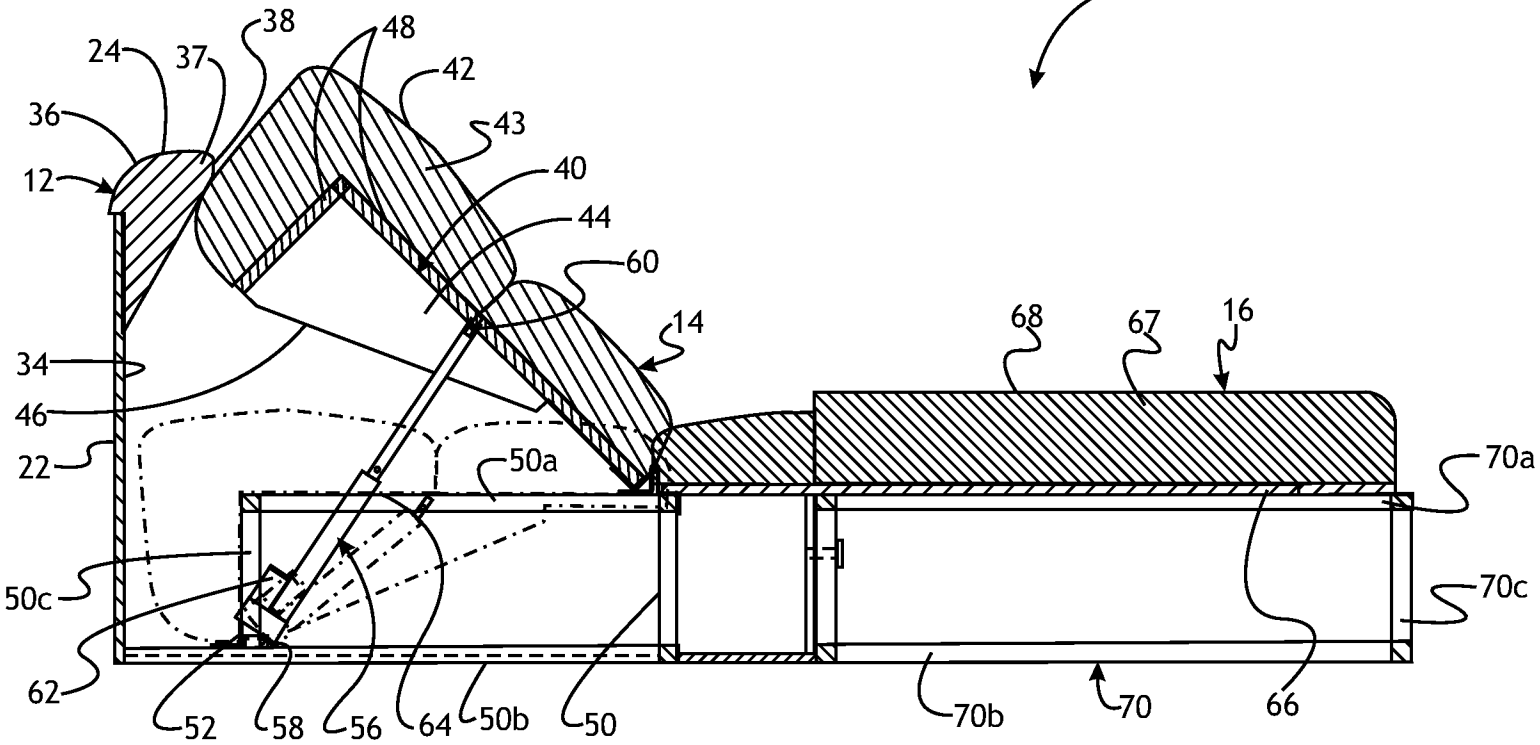
FIG. 3 is a cross-sectional view of one embodiment.

In one embodiment, the intermediate wall 22 includes an inwardly projecting portion 38. The inwardly projecting portion 38 may extend inwardly of the enclosure between the sidewalls 18. A top surface 24 extends on the inwardly projecting portion 38. In one embodiment, the inwardly projecting portion 38 comprises padding 37 and covering 36 extending from the frame 34. The inwardly projecting portion 38 may also be contoured to cooperate with the back 16. As best seen in FIGS. 1 and 3, the inwardly projecting portion 38 may be placed in close proximity to the back 16 when the back is in a first position. In one embodiment, the inwardly projecting portion 38 may contact a portion of the back 16 when the back 16 is in a first position.

At least one of the sidewalls may include an opening 26 for receiving a switch 28. Further, at least one of the sidewalls 18 may include an opening 30 that may include a receptacle 32 for receiving beverage containers. The openings 26, 30 may extend through any frame 34, covering 36 or padding 37.

Figure 5:
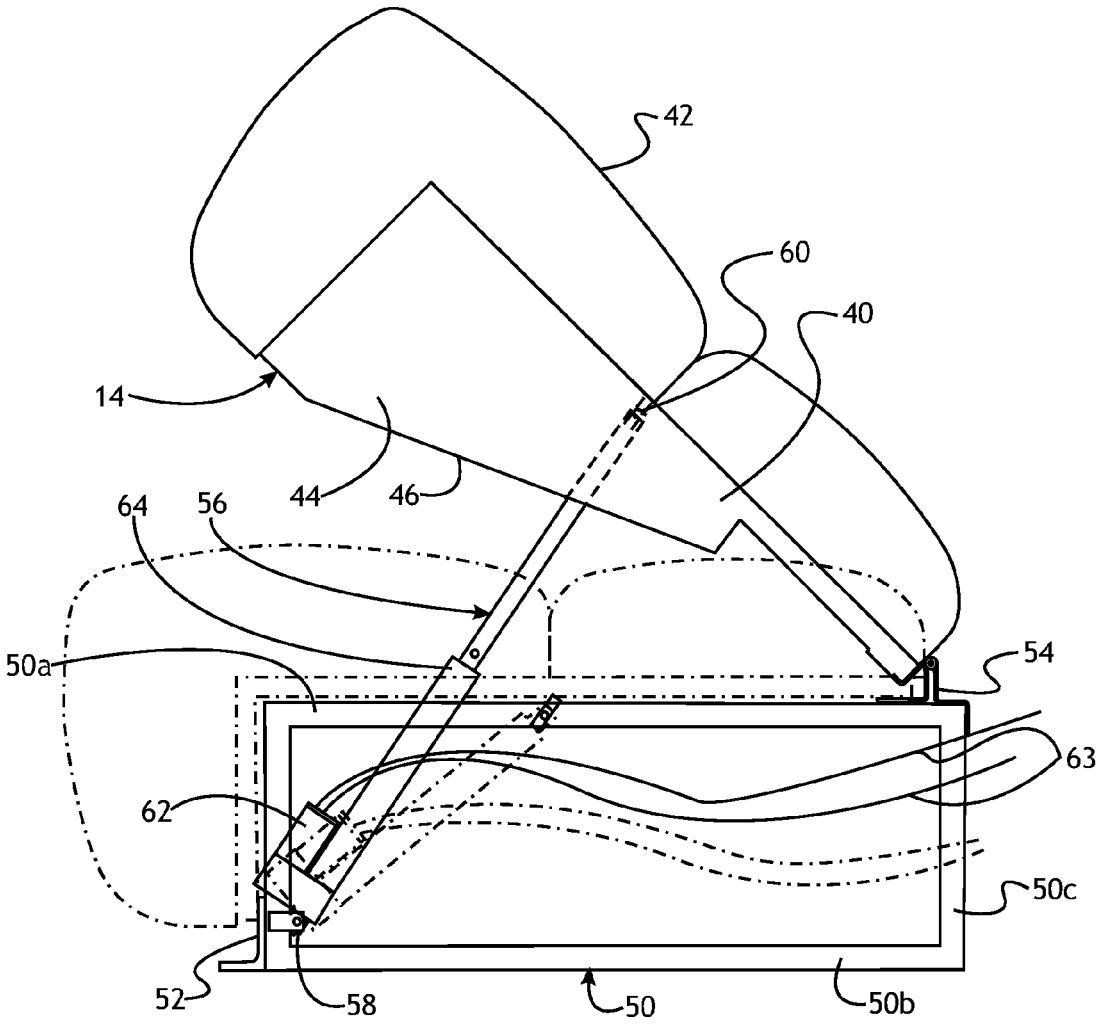
FIG. 5 is a side view of a portion of one embodiment.

The marine seat 10 also includes the back 14. The back 14 and a first frame 50 that may be used to secure the back 14 to a boat deck are shown in FIG. 5. The back 14 may include a frame generally indicated at 40 and a covering 42 on at least a portion of the back 14. Padding 43 may be disposed between the frame 40 and the covering 42. The back 14 may include at least one sidewall 44 that defines a bottom surface 46. The bottom surface 46 may include an angled portion as best seen in FIG. 5. The sidewall 44 may be relatively wider at a position relatively remote from the seat 16 and may be relatively narrower at a position nearer to the seat 16. The sidewall 44 need not extend the entire length of the back 16.

The sidewall 44 may comprise a portion of the frame 40. The sidewall 44 may also include any covering 42 and padding 43 on the portion of the frame 40. In one embodiment, the frame 40 may include a pair of sidewalls 44 and a backing wall 48 disposed between the sidewalls 44. The backing wall 48 may comprise two generally perpendicular positioned sections. The backing wall 48 may provide support for the covering 42 and any intermediate padding 47. The sidewalls 44 may be secured to the peripheral edges of the backing wall 48 and may extend generally perpendicular thereto. The bottom surface 46 may include an angled portion as best seen in FIG. 5. The sidewall 44 may be relatively wider at a position most spaced from the seat 16 and may be relatively narrower at a position nearer to the seat 16. The sidewall 44 need not extend the entire length of the back 16.

In one embodiment, the frame 40 may comprise wood. It will be appreciated that the frame 40 can also comprise any suitable material, such as, plastic or metal. Similarly, combinations of suitable materials may be used for the frame 40. The covering 42 may comprise any suitable covering for a marine environment. Suitable coverings may include a layered covering including a stretchable substructure backing having a vinyl film thereon. The vinyl film may be secured to the substructure by a suitable adhesive. By way of non-limiting example, other suitable coverings may comprise water resistant fabrics, leather, simulated leather, or other plastics, or combinations of materials. The padding 47 may be configured to provide any shape or contour for the back 14. The padding 47 may comprise open and/or closed cell foam or any other suitable material. The padding 47 may be molded.

Figure 4:
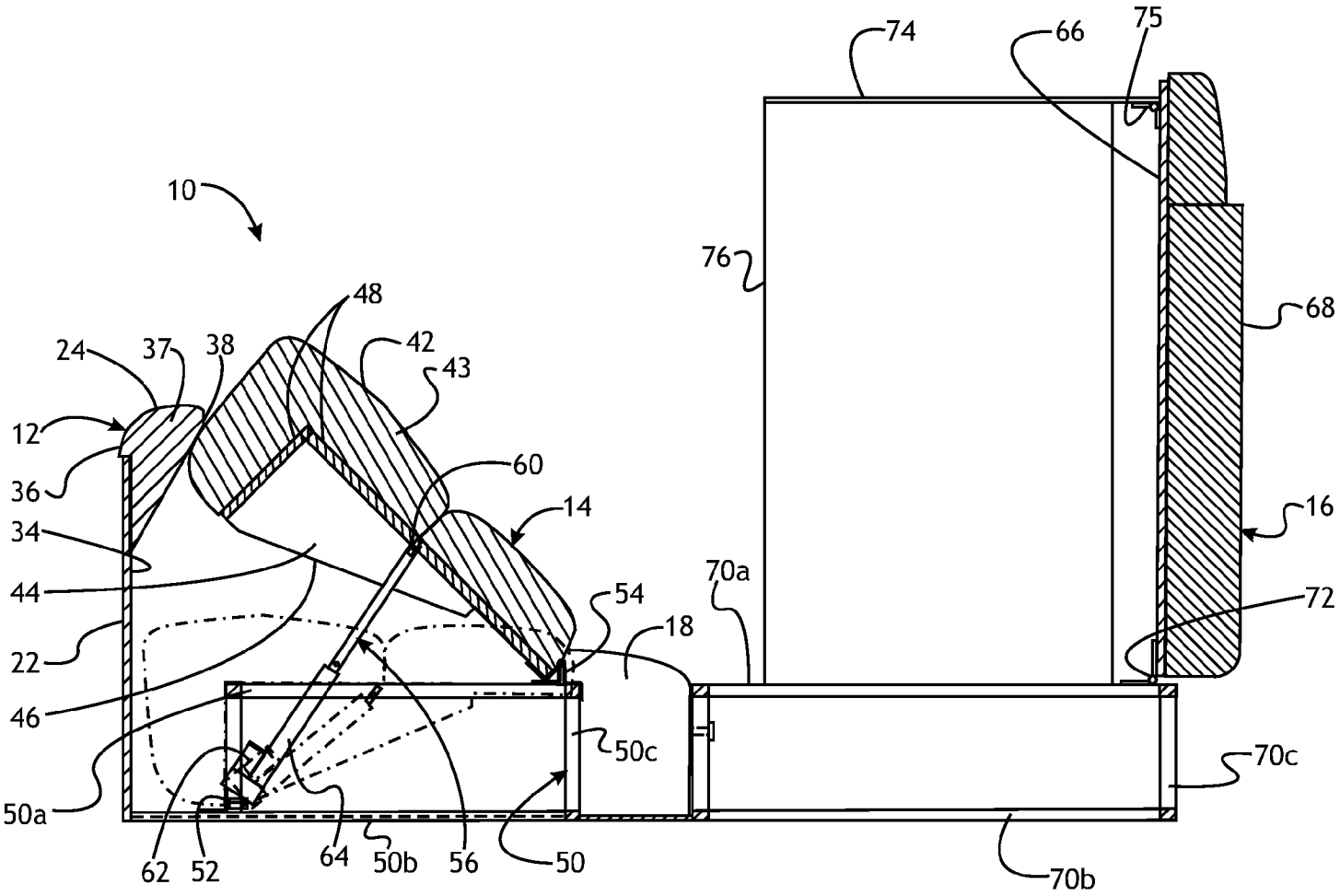
FIG. 4 is a cross-sectional view of one embodiment.

The back 14 is moveable between first and second positions. In one embodiment, the back 14 may be pivotal between the first and second positions. The first position may be a relatively upright position and is shown in FIG. 1 and FIG. 4 in solid lines. The second position may be a relatively reclined or generally horizontal position and is shown in FIG. 2 and in FIG. 4 in broken lines.

Figure 7:
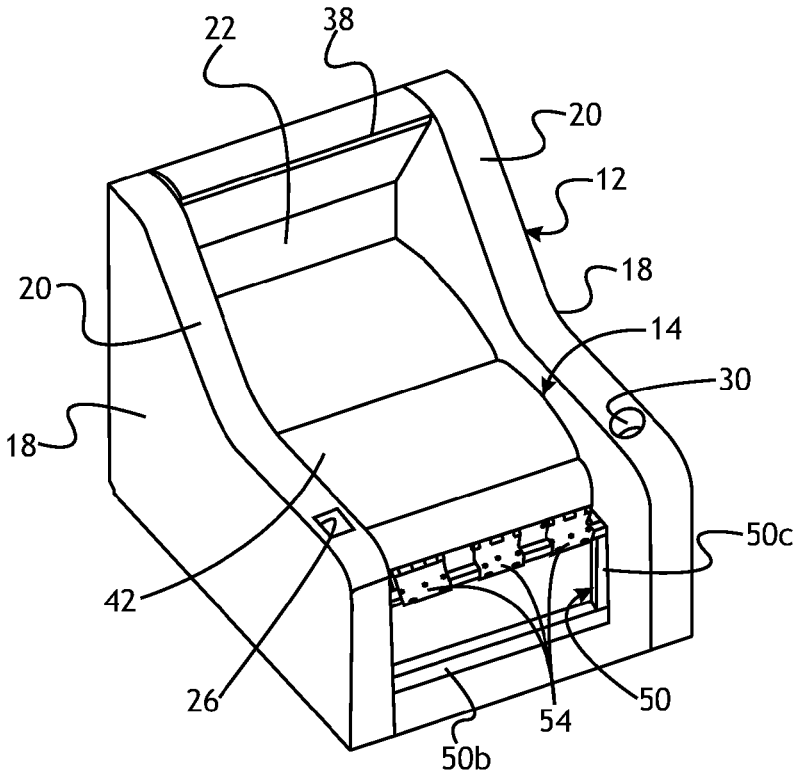
FIG. 7 is a perspective view of a portion of an embodiment.

The back 14 may be pivotal within the enclosure defined by the seat back retainer section 12. FIG. 7 shows the back 14 disposed in the enclosure. When moving between the first and second positions, the bottom surface 46 of the sidewall 44 of the back 14 does not extend above the top surface 20 of the sidewall 18 of the seat back retainer section 12 (FIG. 1). Similarly, the bottom surface 46 of the sidewalls 44 remains below the top surface 24 of the intermediate wall 22 of the seat back retainer section 12 (FIG. 3). This may maintain an enclosed area under the back 14 and between the sidewalls 18 and intermediate wall 22.

In one embodiment, the sidewalls 44 of the back 14 may be positioned in close proximity to the sidewalls 18 of the seat back retainer section 12. In this manner, the seat back 14 may move or pivot within the enclosure defined by seat back retainer section 12 in such a manner that the mechanism for moving the seat is not exposed, and there may be a reduced risk that a user will get any part of their body or clothing caught under the back 14 as it moves between the first and second positions. Similarly, the back 14 and in one embodiment, the covering 42 on the back 14 may be disposed in close proximity or touching the inwardly projecting portion 38 of the seat back retaining section 12 during at least a part of travel of the back 14 between the first and second positions. Again, this too may reduce the risk of a user getting any part of their body or clothing caught in the mechanism or under the back 14 as it is pivoted between the first and second positions.

The reclining marine seat 10 may further include a first frame generally indicated at 50 disposed below the back 14. The first frame 50 may comprise a frame made from tubular metal. The first frame 50 may be used to support the back 14 and secure it to the boat deck. In one embodiment, the first frame 50 may comprise aluminum. The first frame 50 may include four upper frame members **50*a* secured together such as by welding to form a generally rectangular upper frame section. The first frame 50 may also include four lower frame members 50*b* secured together such as by welding to form a generally rectangular lower frame section. A plurality of upright frame members 50*c* may secure the upper and lower frame sections 50*a*, 50*b* to form the first frame 50. The upright frame members 50*c* can be positioned at any location and any number of upright frame members 50*c* may be used. In one embodiment, upright frame members 50 may be positioned in the corners of the upper and lower frame sections. The upright frame members 50*c* can be secured to the upper and lower frame members 50*a*, 50*b* such as by welding. It will be appreciated that the upper frame members 50*a*, lower frame members 50*b* and upright frame members 50*c* can be secured in any other suitable manner. By way of non-limiting example, mechanical fasteners can be used to secure the frame members 50*a*, 50*b* and 50*c*. Similarly, any number of frame members 50*a*, 50*b* and 50*c* may be used. It will be appreciated that the first frame 50** can be made of any suitable material and also may take any suitable configuration.

The first frame 50 may define an open space between the frame members **50*a*, 50*b* and 50*c*. The first frame 50 may include a bracket 52 and may be secured to the deck of a boat using suitable fasteners disposed through the bracket 52 connected to the first frame 50. Similarly, fasteners may extend through the lower frame members 50*b* and into the boat deck. The first frame 50 may be disposed within the enclosure defined by the seat back retainer portion 12. Also, when the back 14 is in the second position, the frame 50 may be disposed between the sidewalls 44 and at least a portion of back wall 48 of the back 14**.

As best seen in FIG. 7, a hinge 54 may be secured to the first frame 50 and to the frame 40 of the back 14 in one embodiment. In this manner, the back 14 is pivotal about the hinge 54 axis between the first and second positions. In one embodiment, a plurality of hinges may be secured to one of the upper frame members 50*a*.

An actuator generally indicated at 56 may be used to move the back 14 between the first and second positions. The actuator 56 may be positioned in the open space between the frame members 50*a*, 50*b* and 50*c*. In one embodiment, the actuator 56 may be moveably connected to the first frame 50 by a first clevis pin assembly 58. The actuator 56 may alternatively be moveably connected to the bracket 52 by the first clevis pin assembly 58. Similarly, a second clevis pin assembly 60 may be secured to the frame 40 of the back 14 (FIG. 5). The actuator 56 may also be moveably connected to the second clevis pin assembly 60. In this manner, the actuator 56 is operatively disposed between the first frame 50 and the back 14 and is disposed within the open space between the first frame members 50*a*, 50*b* and 50*c*.

The actuator 56 may include an electric motor 62 and a ball screw actuator 64. The ball screw actuator 64 is driven between an extended position (solid lines in FIG. 4) and a retracted position (dashed lines in FIG. 4). The actuator 56 may pivot during movement between the extended and retracted positions. The electric motor 62 obtains its energy from any suitable source such as a battery or inverter if dock power is used to energize the motor 62 (not shown). In one embodiment, the electric motor may be a reversible DC motor. It will be appreciated, however, that any suitable motor or mechanism may be used as the actuator 56.

The electric motor 62 may be selectively energized via the switch 28. Switch 28 may be a 3-position switch that allows the user to control energization of the actuator 56 and thereby direct the movement of the back 14 between the first and second positions. It will be appreciated that the switch 28 is coupled with the electric motor 62. In one embodiment, the coupling is by way of electrical wires 63. Similarly, the electric motor may be coupled to the electric source by suitable wires (not shown). By using an electric motor 62 and ball screw actuator 64, the back 14 can be selectively positioned in any of an infinite number of positions between the first and second positions. That is, the actuator 56 can be selectively stopped at any location between its extended and retracted positions. The actuator 56 will maintain the back 14 in the desired position when it is not energized. In this manner, the user may select a position that is most comfortable for the user at any time.

The ball screw actuator 64 further includes limit switches (not shown) that limit the stroke of the ball screw actuator 64 to the first and second positions and positions therebetween. That is, if the user attempts to extend the ball screw actuator 64 beyond the extended position, the limit switch will stop energization of the motor 62 and prevent the back 14 from moving past the first position. Similarly, when the ball screw actual 64 is in the retracted position, a limit switch also stops energy to the motor 62 thereby limiting movement of the back 14 to the second position. While one embodiment of an actuator 56 is shown, it will be appreciated that any suitable actuator 56 may be used. Similarly, the actuator 56 can be connected to the back 14 and frame 50, 52 and/or boat deck in any suitable manner.

The marine seat 10 also includes a seat 16. The seat 16 may support some or all of the weight of a user. The seat 16 may include a frame 66 and a covering 68. Padding 67 may be disposed between the frame 66 and the covering 68. The frame 66 may comprise wood. It will be appreciated that any suitable material such as plastic or metal may be used for the frame. Similarly, combinations of suitable material may be used for the frame 66. The covering 68 may comprise any suitable fabric or covering. Suitable coverings may include a layered covering including a stretchable substructure backing having a vinyl film thereon. The vinyl film may be secured to the substructure by a suitable adhesive. By way of non-limiting example, other suitable coverings may comprise water resistant fabrics, leather, simulated leather, or other plastics, or combinations of materials. The padding 67 may comprise open and/or closed cell foam. The padding 67 may be molded. It will be appreciated that any suitable material may be used for the padding. The frame 66, covering 68 and/or padding 67 may be contoured to provide any desired shape for the seat 16.

The marine seat 10 may include a second frame generally indicated at 70 disposed below the seat 16. The second frame 70 may comprise a frame structure made from one or more frame members 70*a*, 70*b* and 70*c*. Similar to the first frame 50, second frame 70 may include a plurality of upper support members 70*a* which may be secured together in a generally rectangular arrangement. The second frame 70 may include a plurality of lower support members 70*b* which may be secured together in a generally rectangular arrangement. It will be appreciated that a portion of the upper frame members 70*a* and lower frame members 70*b* may be bent to be slightly arcuate on one end. In this way, one end of the second frame member 70 may be arcuate (FIG. 2). A plurality of upright frame members 70*c* may be used to interconnect the upper frame members 70*a* and lower frame members 70*b*. A suitable covering 71 may be disposed about a portion of the tubular frame members 70*a*, 70*b* and 70*c*.

The frame members 70*a*, 70*b* and 70*c* may comprise any suitable material. In one embodiment, the frame members 70*a*, 70*b* and 70*c* may comprise tubular aluminum. It will be appreciated, however, that as with the frame members 50*a*, 50*b* and 50*c*, the frame members 70*a*, 70*b* and 70*c* may take any suitable configuration and may comprise any suitable material. The frame members 70*a*, 70*b* and 70*c* can be secured together in any suitable manner. In one embodiment the frame members 70*a*, 70*b* and 70*c* may be secured by welding. In one embodiment, the frame members 70*a*, 70*b* and 70*c* may be secured together using mechanical fasteners.

The second frame 70 may include an open space between the frame members 70*a*, 70*b* and 70*c*. The second frame 70 may be secured to the deck of a boat using suitable fasteners disposed through the lower frame members 70*b* (not shown). Alternatively, the frame 70 may be connected to the deck of a boat by brackets (not shown) connected to the second frame 70. The second frame 70 may be secured to the sidewall 18 of the seat back retainer section 12. As shown in FIG. 4, at least one of the frame member 70*c* may have a fastener therethrough which secures the second frame 70 to the sidewall 18. In one embodiment, one frame member 70*c* may be secured to each sidewall 18.

The seat 16, and particularly the frame 66 thereof, may be supported on the second frame 70. A hinge 72 (FIG. 4) may be used to secure the seat 16 with the second frame 70. In one embodiment, the hinge 72 is at one end of the seat 16. More than one hinge 72 may be used.

The seat 16 and particularly the frame 66 thereof may extend to and be supported on the first frame 50. More particularly, the seat 16 may get relatively narrower at one end. A portion of the seat 16 may extend into the enclosure defined by the seat back retainer section 12 between the sidewalls 18.

This portion of the seat 16 may be supported on the upper frame member 50*a* of the first frame 50. In this manner, any gap between the back 14 and seat 16 may be small.

In one embodiment, the seat 16 may also pivot relative to the second frame 70. The seat 16 may pivot between a first position as shown in FIG. 3 and a second position as shown in FIG. 4. In the second position, the seat 16 may be positioned in a relatively upright position. This position exposes the second frame 70 and exposes the second frame 70. In one embodiment, there is an interior space defined by the second frame 70 between the frame members 70*a*, 70*b* and 70*c*.

The frame 66 of seat 16 may include an enclosure support 74 thereon (FIG. 4). The enclosure support 74 may be supported on one or more hinges 75 and may be moveable between first and second positions. The enclosure support 74 may comprise a generally u-shaped support. In one embodiment, the enclosure support 74 is made from tubular aluminum. It will be appreciated that the enclosure support may comprise any suitable material and may take any suitable configuration. When the seat 16 is in the first position, the enclosure support 74 is pivoted such that it is positioned adjacent the frame 66 (not shown). When the frame 66 and seat 16 are moved to the second position (FIG. 4), the enclosure support 74 may be pivoted about hinge 75 to its second position. In the second position, the enclosure support 74 can be extended to support an enclosure 76. The enclosure 76 may comprise any suitable enclosure 76. In one embodiment, the enclosure 76 can be foldable, such as a curtain or the like. The enclosure 76 or curtain may be extended about the enclosure support 74. The enclosure 76 may thus be used to close off an area so that a user can have privacy. The enclosure 76 can be used for any purpose such as to provide a changing area or to enclose a portable marine toilet which may be placed in an interior space defined by the second frame 70. The enclosure 76 may provide privacy for a user of such a toilet (not shown).

The description of the invention is merely exemplary in nature and, thus, variations that do not depart from the gist of the invention are intended to be within the scope of the invention. Such variations are not to be regarded as a departure from the spirit and scope of the invention.

What is claimed is:

1. A reclining marine seat comprising:

a seat back retainer section having at least one sidewall defining a top surface and having an intermediate wall located adjacent the at least one sidewall;

a back for supporting an occupant's back body, the back having at least one sidewall defining a bottom surface, the back being pivotal between first and second positions within the seat back retainer section such that the bottom surface of the back does not extend above the top surface of the seat back retainer section during movement of the back between the first and second positions, wherein movement of the back between the first and second positions is independent of a seat of the reclining marine seat such that the seat remains stationary as the back moves between the first and second positions, the seat for supporting an occupant's legs, and wherein a terminal end surface of the back opposite its pivot is in surface-to-surface confrontation with the intermediate wall of the seat back retainer section when the back is in the second position;

a first frame disposed below the back, the back being pivotally secured to the first frame; and an actuator secured to the first frame and to the back, the actuator moving the back between the first and second positions.

2. A reclining marine seat as set forth in claim 1 wherein the seat back retainer section comprises a pair of side walls and the intermediate wall is disposed between said pair of side walls, said intermediate wall defining a top surface, at least a portion of the back remains below top surface during movement of the back between the first and second positions.

3. A reclining marine seat as set forth in claim 1 wherein the actuator includes an electric motor and a ball screw actuator.

4. A reclining marine seat as set forth in claim 3 further including a switch coupled with the electric motor.

5. A reclining marine seat as set forth in claim 1 wherein the back can be retained in any position between the first and second positions.

6. A reclining marine seat as set forth in claim 1 further comprising a second frame and the seat is supported on said second frame.

7. A reclining marine seat as set forth in claim 6 wherein the seat is supported in a first position on said first and said second frame.

8. A reclining marine seat as set forth in claim 6 wherein the seat is pivotally disposed on the second frame and is pivotal between first and second positions.

9. A reclining marine seat as set forth in claim 7 wherein the seat includes an enclosure support, the enclosure support being moveable between first and second positions.

10. A reclining marine seat as set forth in claim 8 further including an enclosure on said enclosure support.

11. A reclining marine seat comprising a seat retainer portion having an intermediate wall with an inwardly projecting portion;

a first frame secured to the deck of a boat and disposed within said seat retainer portion;

a back for supporting an occupant's back body, the back supported on said first frame and being pivotal between first and second positions; and an actuator coupled to the back and capable of moving the back between the first and the second positions and wherein the back can be retained in any position between the first and the second positions, wherein movement of the back between the first and second positions is independent of a seat of the reclining marine seat such that the seat remains stationary as the back moves between the first and second positions, the seat for supporting an occupant's legs, and wherein a terminal end surface of the back opposite its pivot is in surface-to-surface contact with the inwardly projecting portion of the seat retainer portion when the back is in the first position.

12. A reclining marine seat as set forth in claim 11 further comprising a second frame and the seat supported on said second frame.

13. A reclining marine seat as set forth in claim 12 wherein said seat is supported on the first frame and the second frame.

14. A reclining marine seat as set forth in claim 11 wherein the actuator includes an electric motor and a ball screw actuator.

15. A reclining marine seat as set forth in claim 14 further including a switch coupled with the electric motor.

16. A reclining marine seat as set forth in claim 12 wherein the first frame and the second frame are secured to the deck of a boat.

17. A reclining marine seat comprising:

a seat back retainer section having a pair of sidewalls, at least one of the sidewalls defining a top surface, the seat back retainer section also having an intermediate wall disposed between the sidewalls to provide a generally u-shaped enclosure;

a first frame;

a back for supporting an occupant's back body, the back disposed in the generally u-shaped enclosure of the seat back retainer section and disposed on the first frame and having at least one sidewall defining a bottom surface, the back being pivotal between first and second positions within the seat back retainer section such that the bottom surface of the back does not extend above the top surface of the seat back retainer section during movement of the back between the first and second positions; and an actuator coupled to the back and capable of moving the back between the first and the second positions and wherein the back can be retained in any position between the first and the second positions, wherein movement of the back between the first and second positions is independent of a seat of the reclining marine seat such that the seat remains stationary as the back moves between the first and second positions, the seat for supporting an occupant's legs, and wherein a terminal end surface of the back opposite its pivot is in surface-to-surface confrontation with the intermediate wall of the seat back retainer section when the back is in the second position, and sidewalls of the back are in close proximity with respective sidewalls of the seat back retainer section when the back is in the second position.

18. A reclining marine seat as set forth in claim 17 further comprising a second frame and the seat supported on said second frame and the first frame.

* * * * *